US008187072B2

(12) United States Patent
Costello et al.

(10) Patent No.: US 8,187,072 B2
(45) Date of Patent: May 29, 2012

(54) INSTANT LOTTERY GAME

(75) Inventors: Roxanne Costello, Rosebery (AU); Philippa Graham, Lane Cove (AU); Colin Fong, Lane Cove (AU); Natalie Bryant, Rosebery (AU); Nicholas Luke Bennett, Rosebery (AU)

(73) Assignee: Aristocrat Technologies Australia Pty Ltd (AU)

( * ) Notice: Subject to any disclaimer, the term of this patent is extended or adjusted under 35 U.S.C. 154(b) by 1401 days.

(21) Appl. No.: 10/577,594

(22) PCT Filed: Sep. 27, 2004

(86) PCT No.: PCT/AU2004/001326

§ 371 (c)(1),
(2), (4) Date: Apr. 26, 2006

(87) PCT Pub. No.: WO2005/044410

PCT Pub. Date: May 19, 2005

(65) Prior Publication Data

US 2007/0135198 A1 Jun. 14, 2007

(30) Foreign Application Priority Data

Oct. 28, 2003 (AU) ..... 2003905938

(51) Int. Cl.
*A63F 9/24* (2006.01)

(52) U.S. Cl. ..... 463/16

(58) Field of Classification Search ..... 463/17, 463/16; 273/139
See application file for complete search history.

(56) References Cited

U.S. PATENT DOCUMENTS

| | | | | |
|---|---|---|---|---|
| 5,887,906 | A * | 3/1999 | Sultan | 283/94 |
| 5,934,671 | A * | 8/1999 | Harrison | 273/139 |
| 5,949,042 | A * | 9/1999 | Dietz et al. | 235/375 |
| 6,224,055 | B1 * | 5/2001 | Walker et al. | 273/139 |
| 6,237,913 | B1 * | 5/2001 | Kamille | 273/139 |
| 6,572,107 | B1 | 6/2003 | Walker et al. | |
| 2001/0003100 | A1 | 6/2001 | Yacenda | |
| 2003/0042317 | A1 * | 3/2003 | Behm et al. | 235/487 |
| 2004/0014514 | A1 | 1/2004 | Yacenda | |

FOREIGN PATENT DOCUMENTS

GB 2300816 A 11/1996

OTHER PUBLICATIONS

Examiner's First Report on patent application 2004286721, 6 pages.
Text of the First Office action corresponding to Chinese Patent Application Serial No. 200480032054.0, 4 pages.

* cited by examiner

*Primary Examiner* — Omkar Deodhar
(74) *Attorney, Agent, or Firm* — McAndrews, Held & Malloy, Ltd.

(57) ABSTRACT

An instant lottery game system (10) includes a game play defining element (12). A symbol display zone (14) is carried on the game play defining element (12), the symbol display zone (14) containing a plurality of symbols related to gaming machine games. A masking medium (20) covers the symbols of the symbol display zone (14) prior to use. A symbol interpretation zone (16) is also carried on the game play defining element (12), the symbol interpretation zone (16) carrying a plurality of indicia with the indicia being used in interpreting symbols revealed after removal of the masking medium (20) to determine a prize outcome.

30 Claims, 8 Drawing Sheets

INSTANT LOTTERY GAME

CROSS-REFERENCE TO RELATED APPLICATIONS

The present application claims priority from Provisional Patent Application No. 2003905938 filed on 28 Oct. 2003, the contents of which are incorporated herein by reference.

FIELD OF THE INVENTION

This invention relates to an instant lottery game. More particularly, the invention relates to an instant lottery game system, to an instant lottery game device using gaming machines and their games as themes and to a method of operating an instant lottery game system.

BACKGROUND TO THE INVENTION

Gaming machines, commonly known as spinning reel machines, slot machines, poker machines, or the like exist in which symbol carrying elements such as reels, cards or balls are displayed with symbols thereon determining whether or not a prize is to be awarded.

Particularly with reference to spinning reel type machines, games with various themes are played on these machines. The Applicant has found that certain game themes are more popular than others and gaming machines incorporating such games are played more often than others.

Further, one of the fastest growing fields in the gaming industry is in the field of instant lotteries. Instant lotteries are generally card based where a potential prize is covered by a removable material. A player removes the material to determine whether or not a prize has been won. As this removable material is often scratched off, these instant lottery cards are often referred to as "Scratchies".

The Applicant has determined that instant lottery sales enjoy double-digit growth in many parts of the world and is one of the most popular lottery-type games available.

SUMMARY OF THE INVENTION

According to a first aspect of the invention, there is provided an instant lottery game system which includes:

a game play defining element;

a symbol display zone carried on the game play defining element, the symbol display zone containing a plurality of symbols related to gaming machine games;

a masking medium covering the symbols of the symbol display zone prior to use; and a symbol interpretation zone carried on the game play defining element, the symbol interpretation zone carrying a plurality of indicia with the indicia being used in interpreting symbols revealed after removal of the masking medium to determine a prize outcome.

According to a second aspect of the invention, there is provided an instant lottery game device which includes:

a game play defining element;

a symbol display zone carried on the game play defining element, the symbol display zone containing a plurality of symbols related to gaming machine games;

a masking medium covering the symbols of the symbol display zone prior to use; and a symbol interpretation zone carried on the game play defining element, the symbol interpretation zone carrying a plurality of indicia with the indicia being used in interpreting symbols revealed after removal of the masking medium to determine a prize outcome.

A prize indicating zone may be defined on the game play defining element. The prize indicating zone may, for example, be in the form of a paytable and may contain a range of prizes which a player can possibly win in playing a game carried by the game play defining element.

In one embodiment, the device may be, or the system may be implemented as, a scratch-type card. In that case, the game play defining element may be in the form of a carrier or card on which the symbol display zone, the symbol interpretation zone and the prize indicating zone are carried.

Instead, in another embodiment, the system may be implemented in an electronic format to be played on an electronic device such as, for example, a computer, a TV receiver, a mobile or cellular telephone, or the like. In that case, the game play defining element may be a representation of a card displayed on a screen of the electronic device. The masking medium may then be a virtual covering layer that is "removed" by a player operating predetermined controls of the electronic device such as a touch screen facility of the electronic device or a control panel of the electronic device.

As indicated above, the symbols of the symbol display zone may be representative of gaming machine games. Recourse to the symbol interpretation zone may be required to determine what prize, if any, has been won and revealing of the symbols on their own does not indicate to the player what prize, if any, has been won.

To heighten the sense of anticipation for the player, the symbol interpretation zone may also, initially, be covered by a masking medium. The masking medium may be similar to that of the masking medium of the symbol display zone.

In the case of the device or the instant lottery game system being implemented in the form of a card, the masking medium may be in the form of a removable material which is scratched to be removed from a surface of the card to reveal the symbol display zone and/or the symbol interpretation zone.

It will be appreciated that it is not necessary that the player first remove the masking medium from the symbol display zone and, thereafter, remove the masking medium from the symbol interpretation zone. It is conceivable that the operation could be performed in reverse and the player will still not know until both the symbols and the indicia have been revealed what prize, if any, has been won.

The symbols may be representative of symbols of a spinning reel-type game, the symbols being carried on representations of reels defined in the symbol display zone.

Prior to the game being played, the symbols may be covered by the masking medium to be removed by the player to reveal the symbols.

The indicia of the symbol interpretation zone may include operators related to spinning reel-type game operations such as what constitutes a wild symbol, what constitutes a scatter symbol, how a scatter pay is awarded, whether or not a multiplier is applicable, what line pay regime applies, if a feature has been awarded, whether or not "mixed pay" (which indicates two or more symbols that will pay for a win when occurring in a mixed combination on a payline) applies, whether or not scatter columns or scatter reels apply, whether or not additional paylines are operative or not, etc. It is to be understood that the foregoing list is not to be regarded as exhaustive.

The operators may vary the prize or prizes awarded to a player so that, until the symbol interpretation zone has been referenced by the player, the player will not know what prize or prizes, if any, the player will receive.

The game play defining element may include a further, special feature zone related to a special feature, the special feature zone, initially, being covered by a masking medium. The player may obtain access to the special feature zone only if a "Special Feature" operator is revealed in the symbol interpretation zone, the player removing the masking medium of the special feature zone to determine what special feature prize has been won.

As a variation of the symbol interpretation zone, if the spinning reel-type game has fixed pay type operators such as, for example, line pay, scatter pay, wild symbol and scatter symbol, then headings associated with those operators may not be covered by the masking medium with only specific operators applicable to that specific game being covered by the masking medium.

In yet a further embodiment of the invention, the indicia of the symbol interpretation zone may be directly related to the prizes awarded rather than the symbols of the symbol display zone. For example, the indicia of the symbol interpretation zone may indicate which prize from a range of prizes is to be awarded for a specific combination of symbols revealed by removing the masking medium from the symbol display zone.

According to a third aspect of the invention, there is provided a method of operating an instant lottery game system, the method including the steps of:

providing instant lottery game devices, each game device including a game having a theme related to a gaming machine game, intellectual property relating to the gaming machine games residing in an intellectual property owner who is a party other than an entity involved in the instant lottery game system;

the entity being associated with the sale of instant lottery game devices to members of the public to allow such members of the public to play games on the devices; and the entity paying a percentage of income derived from sales of the instant lottery game devices to the intellectual property owner.

The method may include the intellectual property owner licensing the entity to use themes related to the intellectual property owner's games on the instant lottery game devices.

Further, the method may include the intellectual property owner using the instant lottery game as a vehicle to disseminate information about the intellectual property owner's games.

BRIEF DESCRIPTION OF THE DRAWINGS

Embodiments of the invention are now described by way of example with reference to the accompanying drawings in which.

DETAILED DESCRIPTION OF EXEMPLARY EMBODIMENTS

Figure 1:
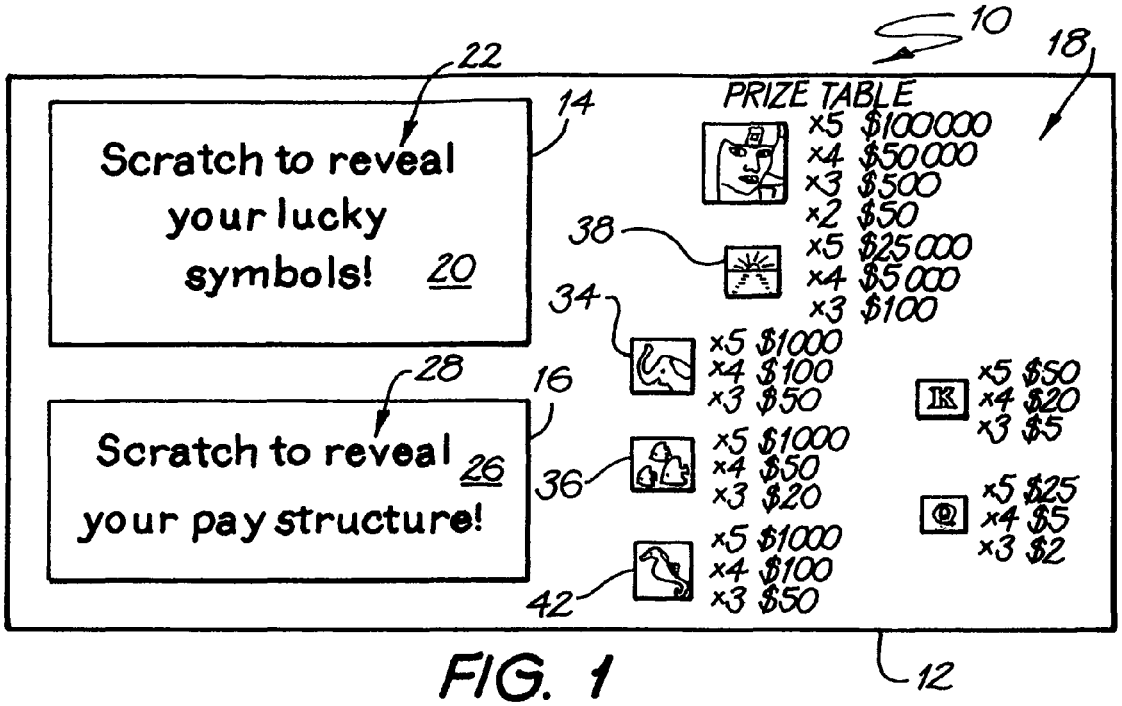
FIG. 1 shows a front view of an instant lottery game system, in accordance with a first embodiment of the invention, prior to use.
Figure 2:
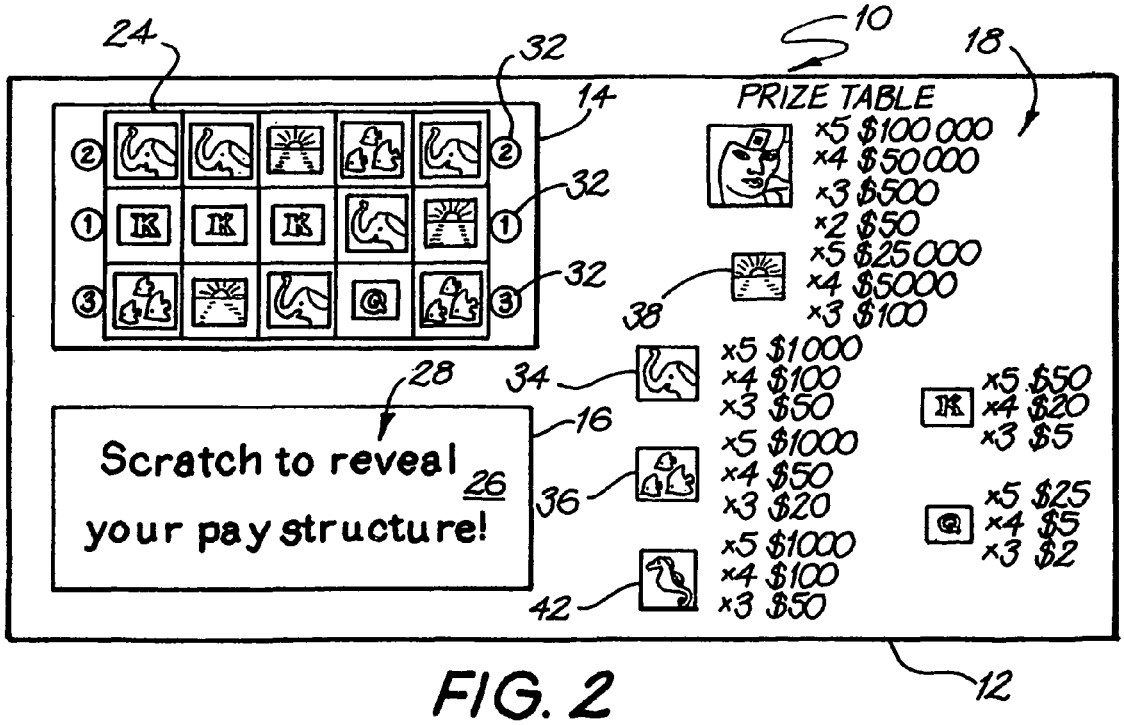
FIGS. 2 and 3 show front views of the instant lottery game system of FIG. 1, in use.
Figure 3:
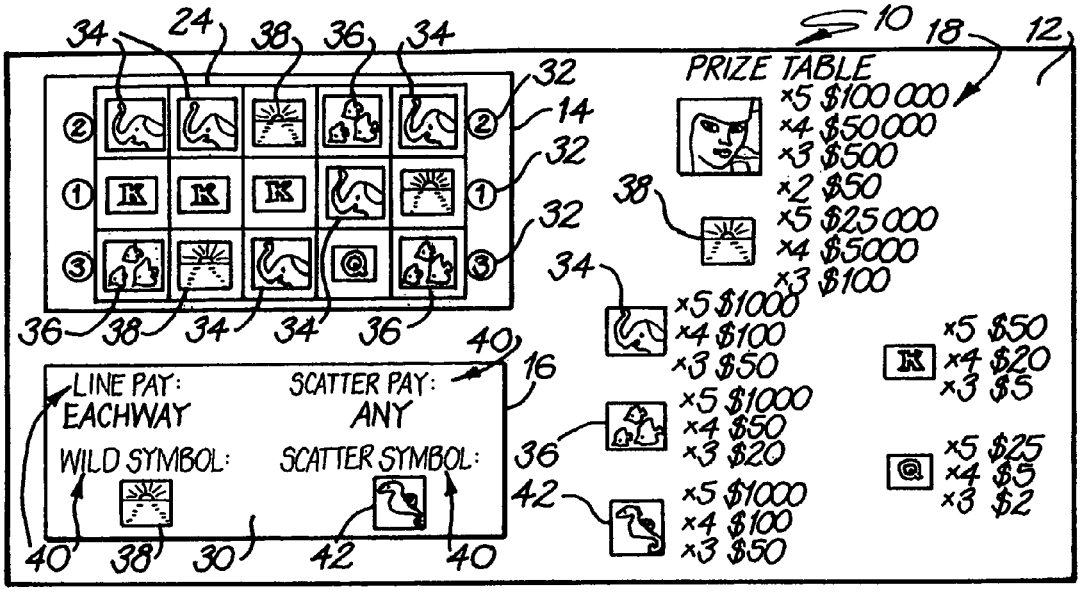

Referring initially to FIGS. 1 to 3 of the drawings, an instant lottery game system, in accordance with a first embodiment of the invention is illustrated and is designated generally by the reference numeral 10. The game system 10 includes a game play defining element in the form of a card 12. In this regard, it is to be noted that the various embodiments of the invention to be described will be described with reference to their implementation as scratch card-type games. It will be appreciated by those skilled in the art that the game 10 could equally well be implemented in an electronic format by appropriate programming and/or transmission techniques.

A symbol display zone 14 is defined on the card 12 as is a symbol interpretation zone 16.

In addition, a prize indicating zone having a prize table 18 is carried on the card 12.

In this embodiment of the invention, the symbol display zone 14 is, initially, covered by a masking medium in the form of a scratch-off covering 20. A message 22 is printed on the covering 20 to act as an instruction to the player to scratch-off the covering 20 to reveal symbols 24 (FIG. 2), as will be described in greater detail below.

In addition, the symbol interpretation zone 16 is also initially covered by a covering 26 of a masking medium. Once again, the covering 26 carries a message 28 to instruct the player to remove the covering 26 to reveal indicia 30 (FIG. 3) which are to be used in interpreting the symbols 24 to determine a prize outcome.

A theme of the game 10 relates to a gaming machine game and, more particularly, a spinning reel-type gaming machine game. Optimally, the games are the Applicant's most popular games such as, for example, the Applicant's "Queen of the Nile"® game ("Queen of the Nile" is a Registered Trade Mark of Aristocrat Technologies Australia Pty Ltd).

When a player purchases one of the games 10, the player scratches off the covering 20 of the zone 14 to reveal the symbols 24. The symbols 24 are arranged in the zone 14 in a manner similar to the display of a spinning reel game where five reels each have three visible display positions. Hence, the symbols 24 are arranged in a 3×5 matrix in the symbol display zone 14 and paylines 32 are applicable.

Preferably, artwork on the card 12 is designed to resemble that of a gaming machine with the symbol display zone 14 being representative of a screen of the gaming machine.

In the examples shown in FIG. 1 to 3 of the drawings, once the covering 20 has been removed, the player still does not know what the results of the game are as the symbol interpretation zone 16 remains covered. The player may have an idea that they have won a prize of $5 for the combination of symbols 3×K on the first payline 32. That would only be applicable if the line pay regime of the game was a left-to-right line pay. In addition, the player does not know if any of the displayed symbols are scatter symbols which could result in other prizes being paid. For example, if an octopus symbol 34 is the scatter symbol then, because five such octopus symbols are displayed, the player could have won a prize of $1,000.

Instead, if a fish symbol 36 is the scatter symbol, the player could have won a prize of $20 for three fish symbols 36. This would only apply if the scatter pay regime applicable was an "any" pay where the scatter symbols need not appear on consecutive "reels".

Still further, if a scatter symbol is a sunset symbol 38, and the scatter pay regime is, once again, an "any" regime then a prize of $100 for three sunset symbols 38 would have been won.

Conversely, if the octopus symbol 34 is a wild symbol and the line pay regime is left-to-right then a prize of $20 for the combination of symbols of 4×K on the first pay line 32 is awarded and a prize of $100 for 3×sunset symbols 38 on the second pay line 32 is awarded.

When the player removes the covering 26 of the symbol interpretation zone 16 various indicia headings 40 are revealed. The indicia 30 are operators as apply in conventional gaming machines as will be described in greater detail below. These headings 40 relate to what operators 30 are applicable to interpret the combinations of symbols 24 to determine the prize outcome. If these headings 40 are constant for all games 10, then these headings 40 may not be covered by the covering 26, only the specific operators 30 below the headings 40 being covered initially by the covering 26.

In this example, the headings 40 are "line pay", "scatter pay", "wild symbol" and "scatter symbols". As illustrated the line pay is "each way" which means that winning combinations may occur in left-to-right combinations and right-to-left combinations on the paylines 32. The scatter pay is "any" which means that the chosen scatter symbol need not occur on consecutive "reels". The sunset symbol 38 is the chosen wild symbol and a seahorse symbol 42 is the scatter symbol.

For the embodiment shown in FIG. 1 to 3 of the drawings, a prize of $5 for 3×K on the first payline 32, paying left-to-right, is awarded and a prize of $50 for 3×octopus symbol 34, with the sunset symbol 38 operating as a wild symbol, is awarded for a total prize of $55. No scatter pay is applicable.

The operators are effectively pay structure rules and the pay structure rules are as for standard gaming machines. For example, pay line wins can be left-to-right, right-to-left, any, or adjacent (i.e. on any consecutive reels).

The wild symbol is the symbol that is used as a substitute for any other symbol. The scatter symbol is a symbol that pays for combinations that do not have to appear on particular paylines 32. In other words, the scatter symbols can appear anywhere on the reels and, where "any" scatter pay wins are applicable, the scatter symbols need not appear on consecutive reels.

In addition, various other operators may be applicable in the symbol interpretation zone. Other operators which could apply are a "multiplier" or "bet" which can be allocated a value. With this arrangement, any winning combination that is revealed will pay the prize from the prize table 18 multiplied by that value.

A "special feature" or "feature trigger" operator indicates a combination that will trigger a further feature game to be revealed in another section of the card 12 or, instead, could be a special prize.

A "mixed pays" operator indicates that two or more symbols, when appearing consecutively in a mixed combination on any of the paylines 32 will pay a prize. A separate prize table segment may apply to mixed pays. Any combinations of the particular symbols that are revealed as mixed pays pay the prize combinations. For example, if 5×mixed pays $1,000 and "mixed pays" reveals two symbols than any winning combination of five of those two symbols in any combination on a payline 32 will pay $1,000.

A "scatter columns" or "scatter reels" operator indicates which of the reels pay as scatters as described in greater detail in the Applicant's Australian Patent No. 684233.

Still further, a "paylines with numbers" operator indicates paylines other than the three horizontal paylines 32 which could be designated within the symbol display zone 14. In that case, the symbol interpretation zone 16 will inform the player which paylines are applicable.

Figure 4:
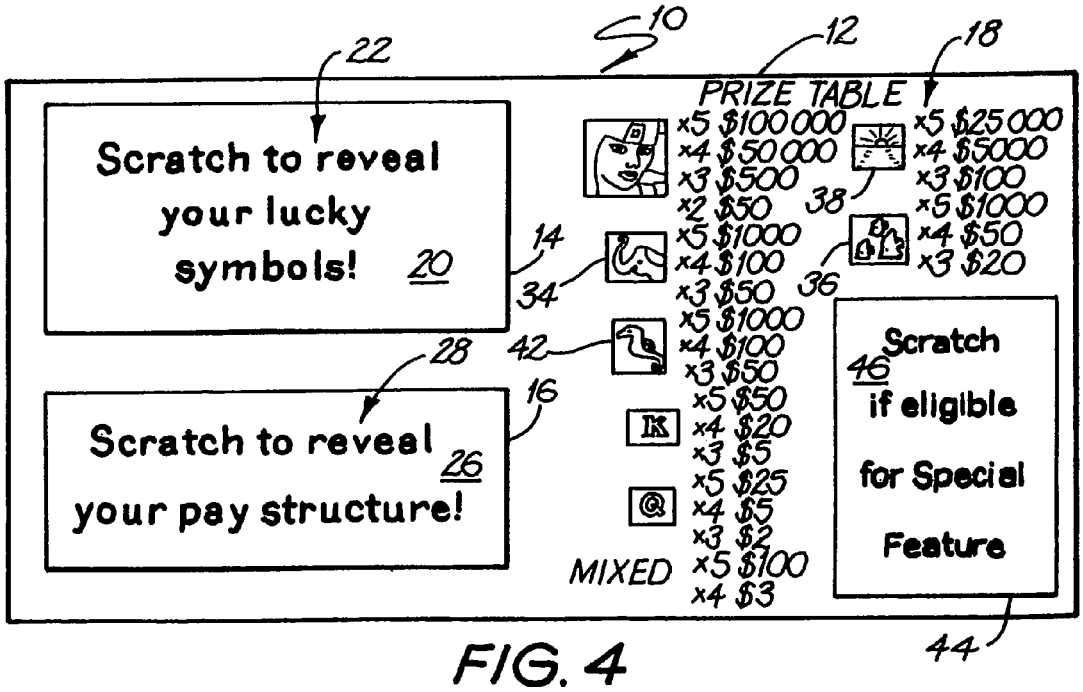
FIG. 4 shows a front view of an instant lottery game system, in accordance with a second embodiment of the invention, prior to use.
Figure 5:
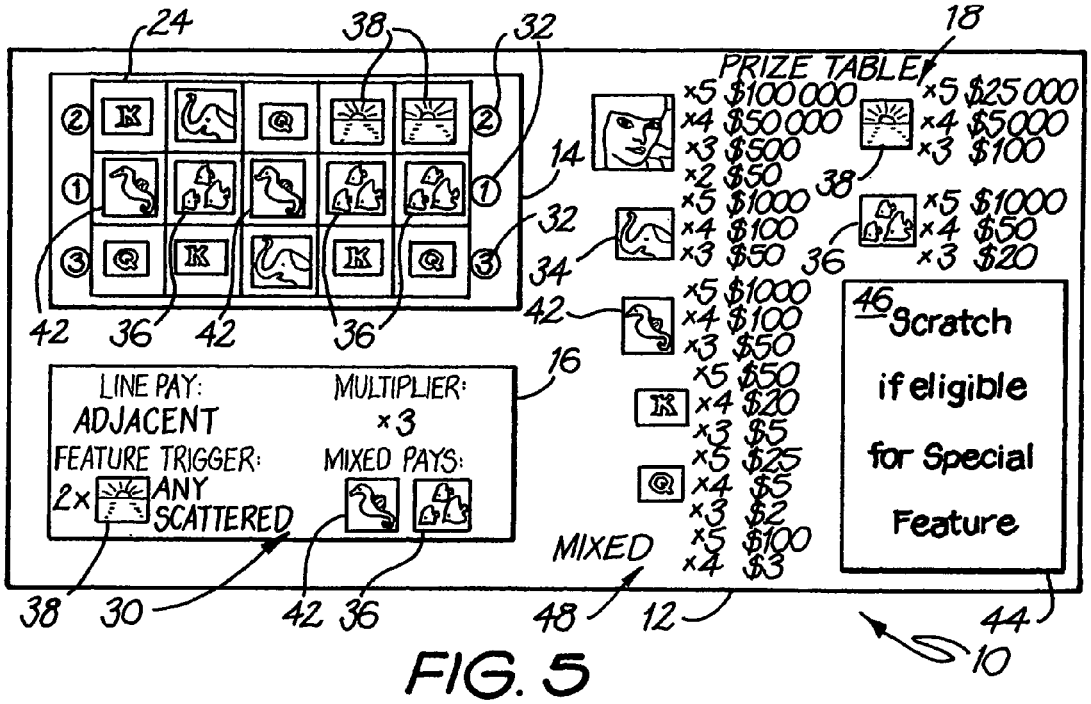
FIGS. 5 and 6 show front views of the instant lottery game system of FIG. 4, in use.
Figure 6:
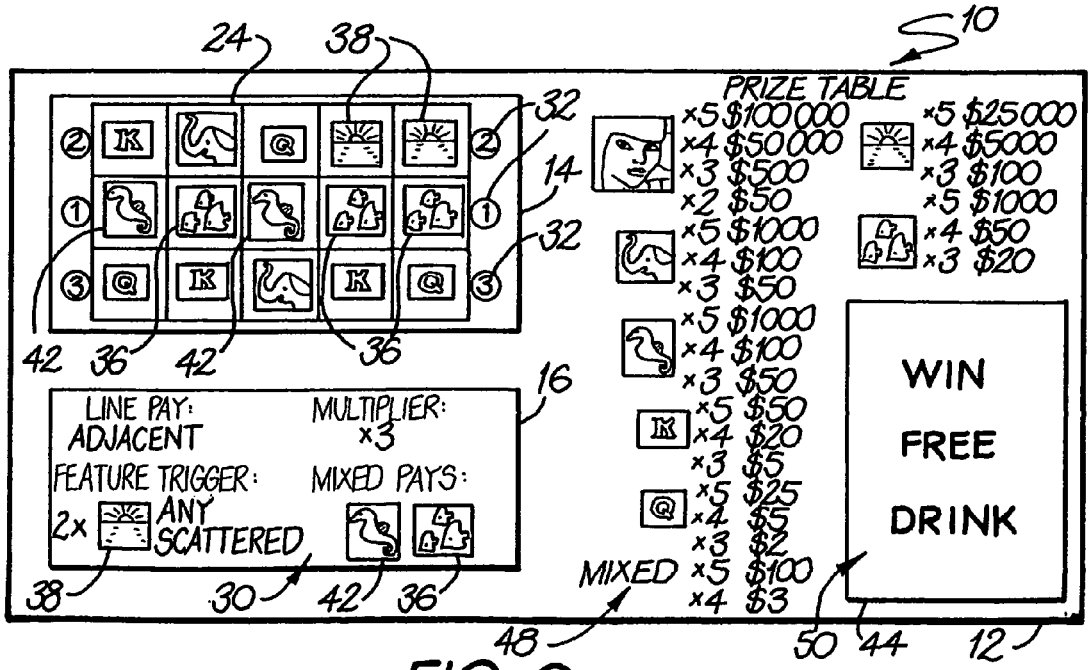

Referring now to FIG. 4 to 6 of the drawings, a second embodiment of the game 10 is described. With reference to FIG. 1 to 3 of the drawings, like reference numerals refer to like parts, unless otherwise specified.

Firstly, in comparison with the embodiment illustrated in FIG. 1 to 3 of the drawings, it is to be noted that a further zone 44 is demarcated on the card 12. This zone 44 is a "special feature" zone and, if the player is eligible for the special feature, the player is to remove a covering 46 covering the zone 44.

Once the player has removed the coverings 20 and 26 from the symbol display zone 14 and the symbol interpretation zone 16, respectively, the card 12 is as shown in FIG. 5 of the drawings.

It is to be noted in the symbol interpretation zone 16 that the operators 30 relate to a line pay, a multiplier, a feature trigger, and a mixed pay. These operator types may vary from game to game. It is also to be noted that the payable 18 includes a segment 48 for the mixed pays.

Thus, in this example, the line pay operator pays for any adjacent symbols, a multiplier of three is applicable, a feature trigger of two sunset symbols 38 in a scattered configuration is applicable and a mixed pay of seahorse symbols 42 and fish symbols 36 applies.

Because a mixed combination of seahorse symbols 42 and fish symbols 36 occurs on the first payline 32 and a multiplier of three applies, a prize of $300 is won by the player.

In addition, two sunset symbols 38 appear. This constitutes the feature trigger entitling the player to remove the covering 46 from the zone 44. In this case, the player wins a free drink as indicated by the message 50.

Thus, the instant lottery game 10 can be used to provide promotional wins which could range from small prizes such as a drink to larger prizes such as an entertainment system, a car, a holiday, or the like.

Figure 7:
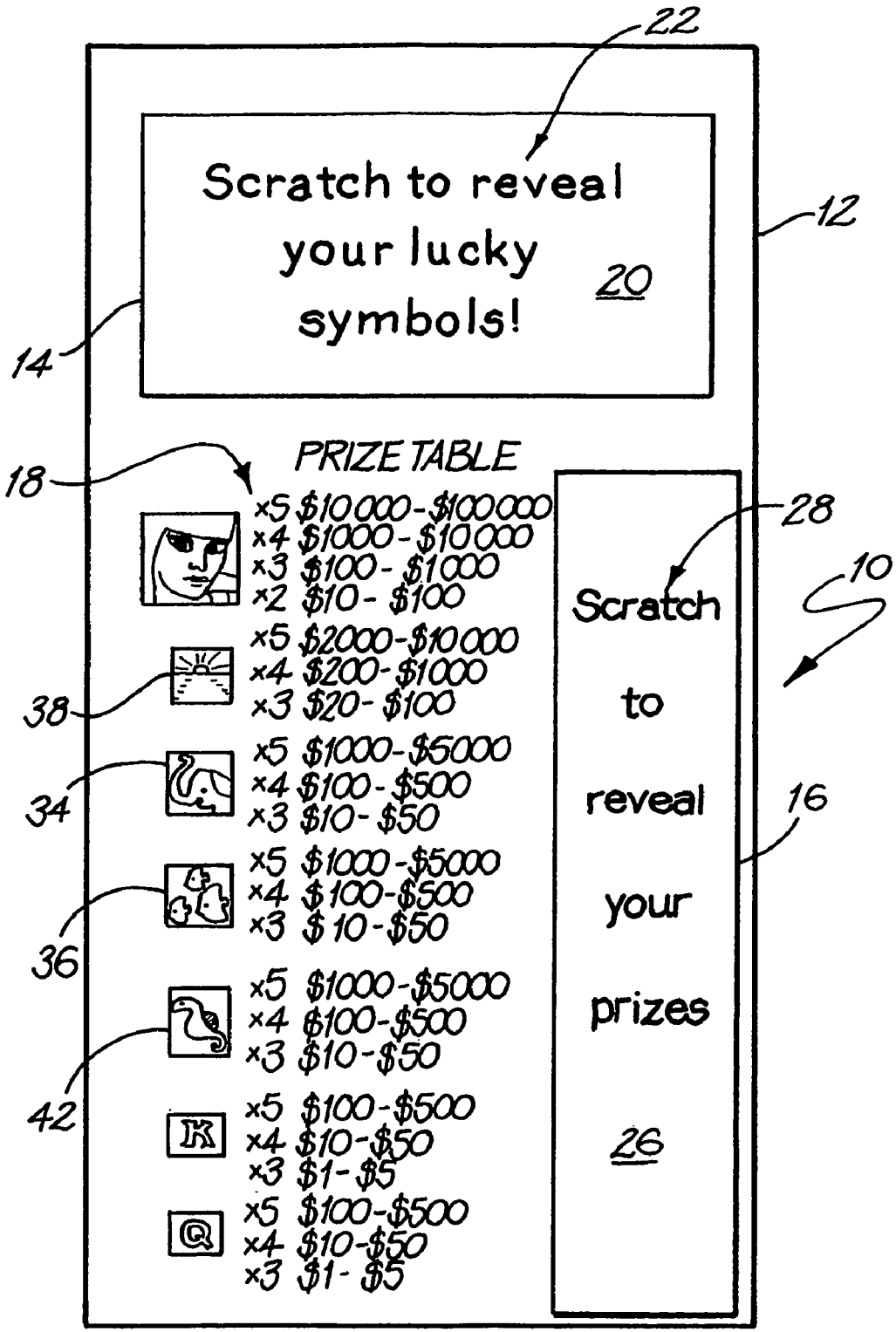
FIG. 7 shows a front view of an instant lottery game system, in accordance with a third embodiment of the invention, prior to use.
Figure 8:
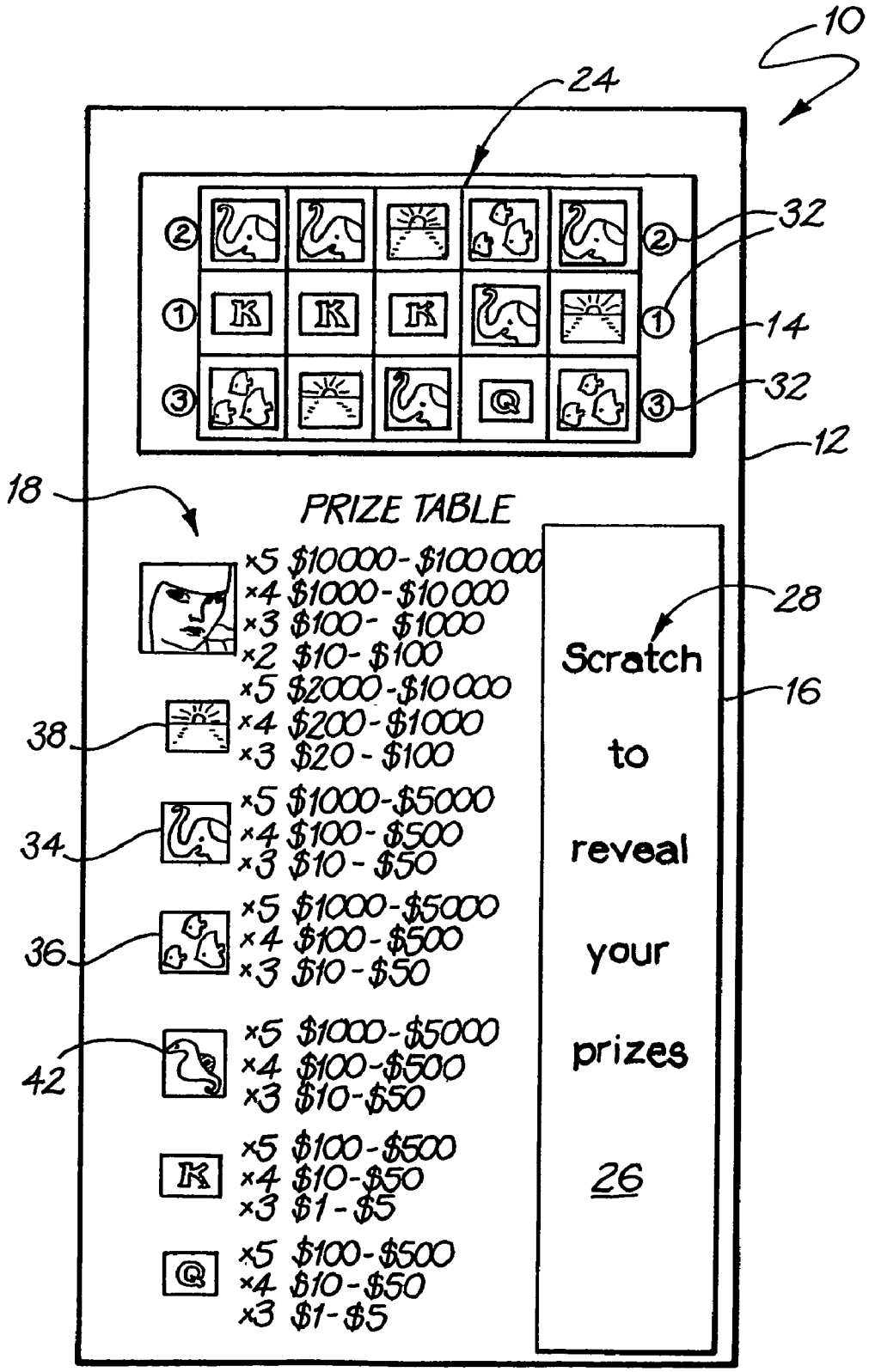
FIGS. 8 and 9 show the instant lottery game system of FIG. 7, in use.
Figure 9:
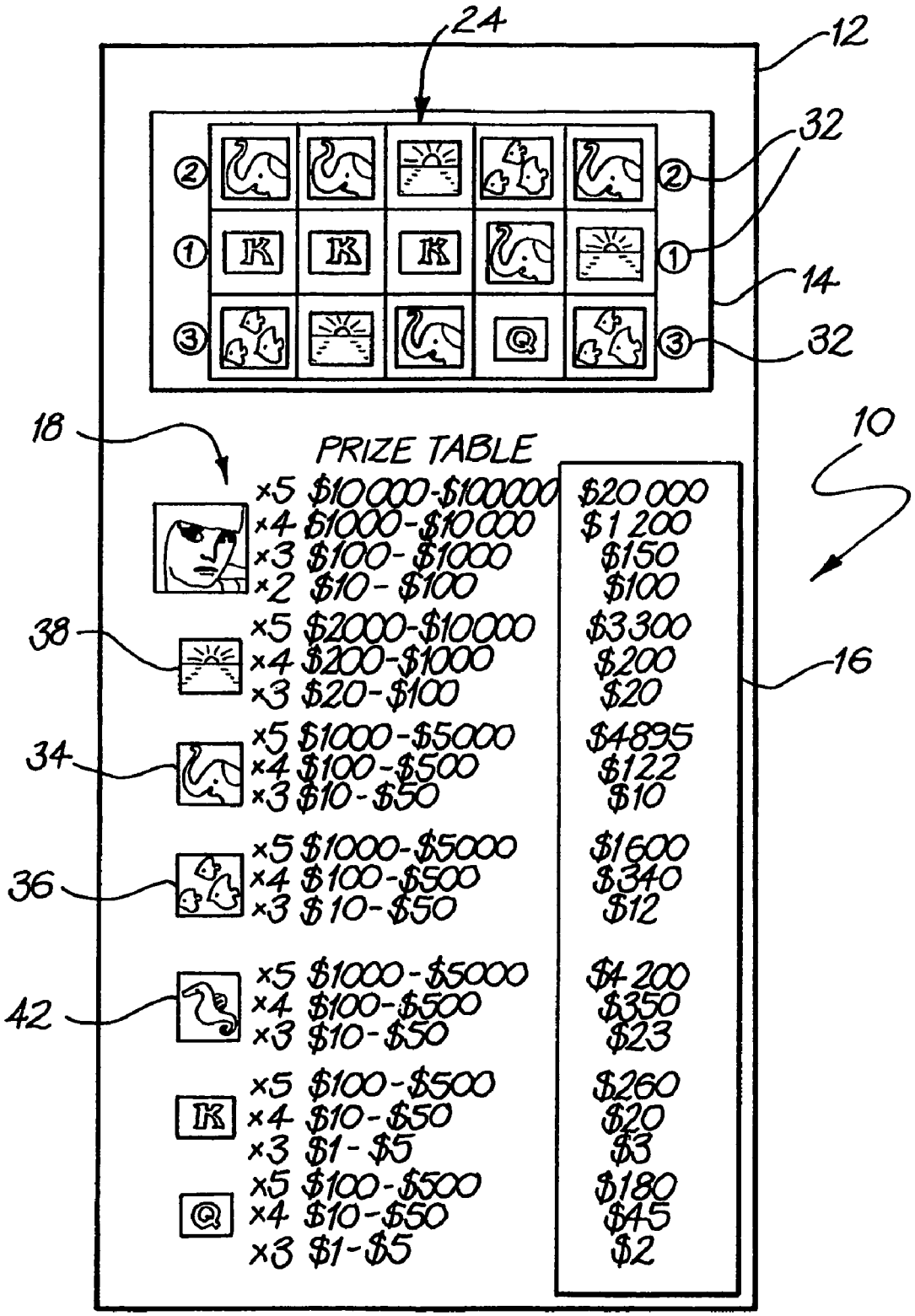

In yet a further embodiment of the invention, as illustrated in FIG. 7 to 9 of the drawings, the prize table 18 is at least partially fixed to provide a range of prizes such as shown in FIG. 7 of the drawings. The symbol interpretation zone 16 is then used to determine precisely what prize has been won. It is to be noted that, once again, with reference to the previous embodiments of the invention, like reference numerals refer to like parts, unless otherwise specified.

The player initially removes the covering 20 from the symbol display zone 14 to reveal the symbols 24 as shown in FIG. 8 of the drawings.

Since all pays are in a predetermined format, such as, for example, a left-to-right format on the paylines 32, the player knows that they have won a prize for 3×K on the first payline 32 and that that prize is between $1 and $5. The player is, at this stage, still not certain as to what prize has been won until the covering 26 has been removed from the symbol interpretation zone 16 as shown in FIG. 9 of the drawings. The player can then determine that a prize of $3 has been won.

It will be appreciated that the player could also play the game in a reverse order and, firstly, remove the covering 26 from the symbol interpretation zone 16 and, thereafter, remove the covering 20 from the symbol display zone 14 to determine the prize won. This applies not only to this embodiment but the earlier embodiments as well. The player still has a heightened sense of anticipation as, until both coverings 20 and 26 have been removed, the player is not certain what prize, if any, has been won.

Figure 10:
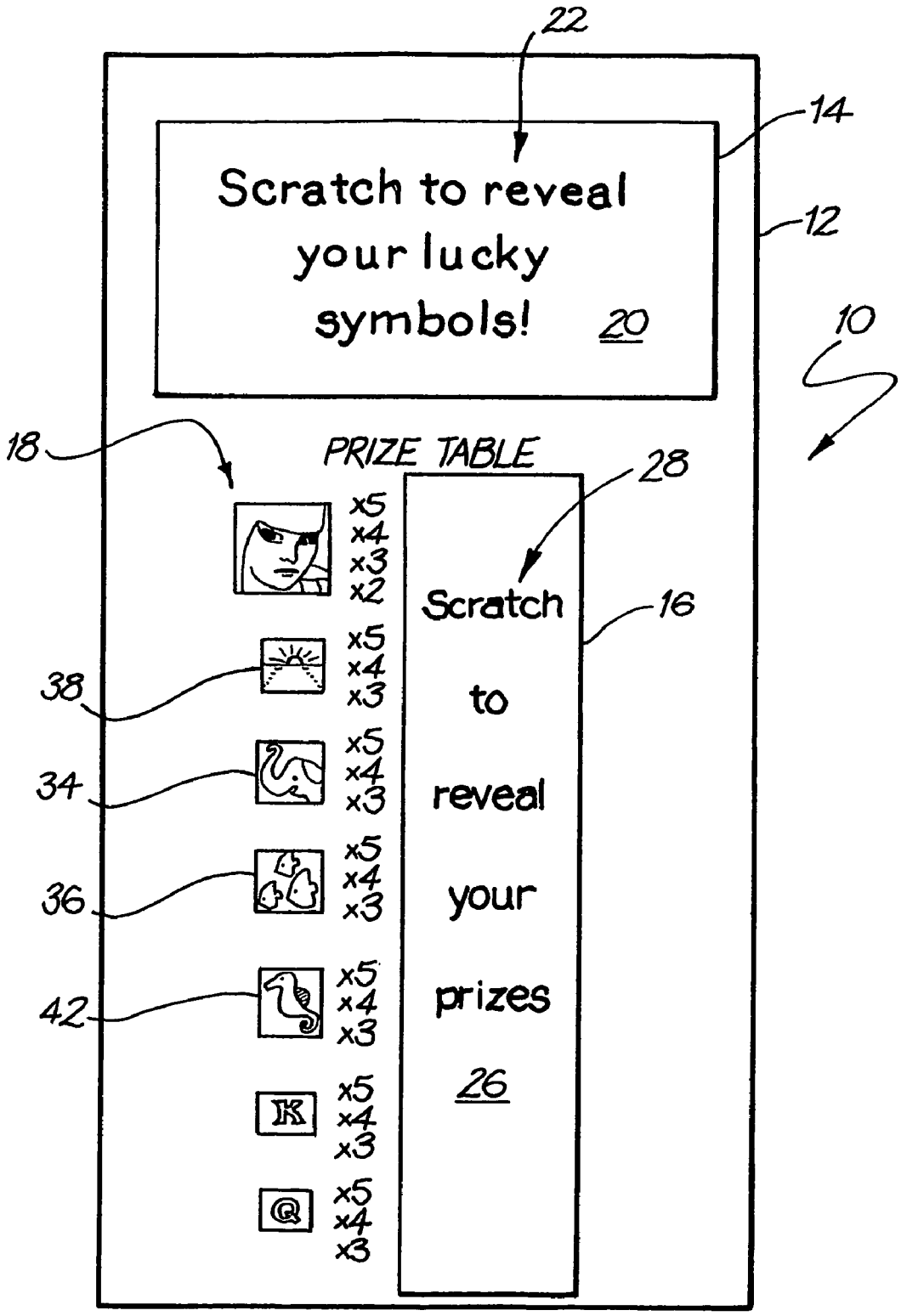
FIG. 10 shows a front view of an instant lottery game system, in accordance with a fourth embodiment of the invention, prior to use.
Figure 11:
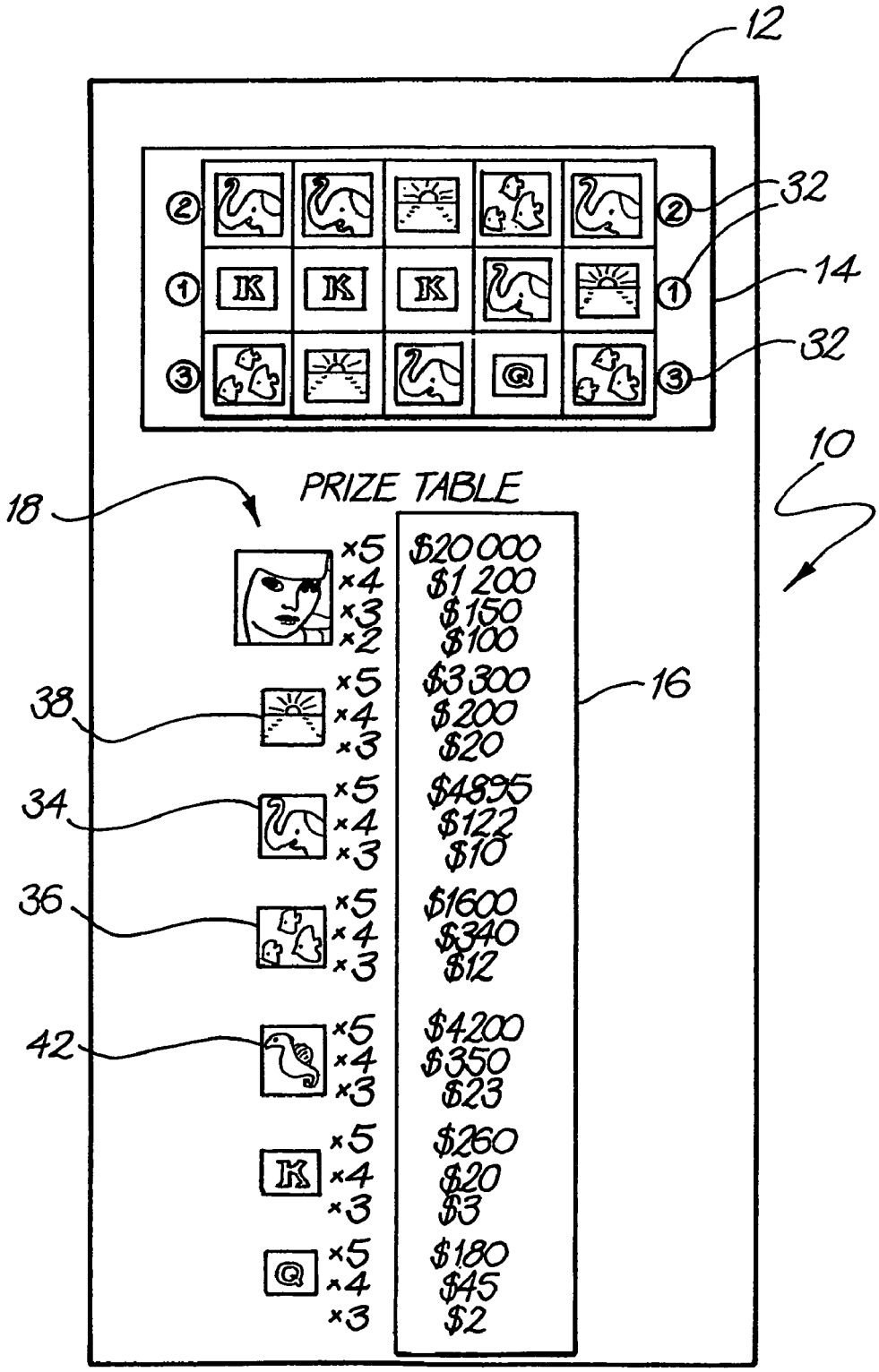
FIG. 11 shows a front view of the instant lottery game system of FIG. 10, in use.

In a variation of this embodiment of the invention, as shown in FIGS. 10 and 11, no prize range at all is displayed initially. Yet again, with reference to the previous embodiments, like reference numerals refer to like parts, unless otherwise specified.

When the coverings 20 and 26 have been removed, the card 12 is as shown in FIG. 11 of the drawings and the player can determine from the symbol interpretation zone 16 that a prize of $3 has been won for the winning combination of 3×K on the first payline 32.

It will be appreciated that, rather than spinning reel type games, the concept can also be applied to other styles of gaming machine games such as poker games, ball games, etc.

It will also be understood that scratch cards are similar to lotteries in that a finite set of cards is printed as a batch where each card has a fixed outcome. The outcome is revealed to the player through a scratch and reveal type game. Different cards win different prizes but the overall return to player for an entire batch of cards is predetermined. Individual cards, with fixed outcomes, are then sold to players. Thus, the games differ from gaming machine games in that there is no random element at all involved in any game although the player does not know the outcome of any one game until the removable medium has been removed to reveal the underlying information.

The Applicant also intends using its gaming machine games on scratch cards to license other parties to distribute the cards and, as a return for using the games, the distributors of the cards pay to the Applicant a royalty. In this way, the Applicant obtains the advantage that its games become more widely disseminated amongst the game player population.

Hence, it is a particular advantage of the invention that the Applicant's games become more widely disseminated amongst a game playing or gaming population. People who regularly play gaming machines will also have the enjoyment of playing instant lottery type games with the recognition of the games involved.

It is a major advantage of the invention that the player needs to uncover at least two regions of the game 10 in order to determine what the prize outcome is. This provides a heightened sense of anticipation and, as a result, enjoyment for the player.

Still further, by licensing the right to use the Applicant's intellectual property attaching to the games, the Applicant's game can reach a wider audience. In addition, a new revenue stream for the Applicant is generated.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An instant lottery game system which includes:

a game play defining element;

a symbol display zone carried on the game play defining element, the symbol display zone containing a plurality of symbols providing a spinning reel game outcome;

a symbol interpretation zone carried on the game play defining element;

a masking medium covering the symbols of the symbol display zone and the symbol interpretation zone prior to game play; and wherein when the plurality of symbols in the symbol display zone are revealed, the game outcome of the instant lottery game is still unknown; and wherein the symbol interpretation zone carries a plurality of indicia representing one or more operators that apply to at least one of said plurality of symbols, the indicia used in interpreting said plurality of symbols to thereby determine the game outcome and a prize associated with said game outcome.

2. The system of claim 1 and further comprising a prize indicating zone being carried on the game play defining element.

3. The system of claim 2 in which the prize indicating zone includes a paytable and a range of prizes which a player can possibly win in playing a game carried by the game play defining element.

4. The system of claim 2 wherein said game play defining element is a scratch-type card.

5. The system of claim 2, and wherein the game play defining element is in the form of a carrier on which the symbol display zone, the symbol interpretation zone and the prize indicating zone are carried.

6. The system of claim 2 wherein said game play defining element is implemented in an electronic format to be played on an electronic device.

7. The system of claim 6 in which the game play defining element is a representation of a card displayed on a screen of the electronic device.

8. The system of claim 7 in which the masking medium is a virtual covering layer that is removed by a player operating predetermined controls of the electronic device.

9. The system of claim 1 in which recourse to the symbol interpretation zone is required to determine what prize, if any, has been won and revealing of the symbols on their own does not indicate to the player what prize, if any, has been won.

10. The system of claim 1, wherein said masking medium comprises first and second masks, and wherein said first mask covering said symbol display zone, and wherein said second mask covering said symbol interpretation zone.

11. The system of claim 1 in which the symbols are representative of symbols of a spinning reel-type game, the symbols being carried on representations of reels defined in the symbol display zone.

12. The system of claim 11 in which the indicia of the symbol interpretation zone include operators related to spinning reel-type game operations.

13. The system of claim 12 in which the operators vary the prize awarded to a player so that, until the symbol interpretation zone has been referenced by the player, the player will not know what prize or prizes, if any, the player will receive.

14. The system of claim 1, wherein said masking medium comprises first mask, and wherein the game play defining element includes a special feature zone related to a special feature, the special feature zone, prior to game play, being covered by a second mask.

15. The system of claim 14 and wherein the player obtains access to the special feature zone only if a special feature indicium is revealed in the symbol interpretation zone, the player removing the masking medium of the special feature zone to determine what special feature prize has been won.

16. The system of claim 12 in which, if the spinning reel-type game has fixed pay type operators, headings associated with those operators are not covered by the masking medium with only specific operators applicable to that specific game being covered by the masking medium.

17. The system of claim 12 in which the indicia of the symbol interpretation zone are directly related to the prizes awarded rather than the symbols of the symbol display zone.

18. An instant lottery game device which includes:

a game play defining element;

a symbol display zone carried on the game play defining element, the symbol display zone containing a plurality of symbols providing a spinning reel game outcome;

a symbol interpretation zone carried on the game play defining element;

a masking medium covering the symbols of the symbol display zone and the symbol interpretation zone prior to game play; and wherein when the plurality of symbols in the symbol display zone are revealed, the game outcome of the instant lottery game is still unknown; and wherein the symbol interpretation zone carries a plurality of indicia representing one or more operators that apply to at least one of said plurality of symbols, the indicia used in interpreting said plurality of symbols to thereby determine the game outcome and a prize associated with said game outcome.

19. The device of claim 18 and further comprising a prize indicating zone being carried on the game play defining element.

20. The device of claim 19 in which the prize indicating zone includes a paytable and a range of prizes which a player can possibly win in playing a game carried by the game play defining element.

21. The device of claim 18, and wherein the game play defining element is in the form of a carrier on which the symbol display zone, the symbol interpretation zone and the prize indicating zone are carried.

22. The device of claim 18 in which recourse to the symbol interpretation zone is required to determine what prize, if any, has been won and revealing of the symbols on their own does not indicate to the player what prize, if any, has been won.

23. The device of claim 18, wherein said masking medium comprises first and second masks, and wherein said first mask covering said symbol display zone, and wherein said second mask covering said symbol interpretation zone.

24. The device of claim 18 in which the symbols are representative of symbols of a spinning reel-type game, the symbols being carried on representations of reels defined in the symbol display zone.

25. The device of claim 24 in which the indicia of the symbol interpretation zone include operators related to spinning reel-type game operations.

26. The device of claim 25 in which the operators vary the prize awarded to a player so that, until the symbol interpretation zone has been referenced by the player, the player will not know what prize or prizes, if any, the player will receive.

27. The device of claim 18, wherein said masking medium comprises first mask, and wherein the game play defining element includes a special feature zone related to a special feature, the special feature zone, prior to game play, being covered by a second mask.

28. The device of claim 27, and wherein the player obtains access to the special feature zone only if a special feature indicium is revealed in the symbol interpretation zone, the player removing the masking medium of the special feature zone to determine what special feature prize has been won.

29. The device of claim 25 in which, if the spinning reel-type game has fixed pay type operators, headings associated with those operators are not covered by the masking medium with only specific operators applicable to that specific game being covered by the masking medium.

30. The device of claim 25 in which the indicia of the symbol interpretation zone are directly related to the prizes awarded rather than the symbols of the symbol display zone.

* * * * *